United States Patent [19]

Formanek et al.

[11] Patent Number: 4,551,172

[45] Date of Patent: Nov. 5, 1985

[54] PROCESS OF PRODUCING LIQUID CARBON-CONTAINING IRON

[75] Inventors: Lothar Formanek, Frankfurt am Main; Martin Hirsch, Friedrichsdorf; Harry Serbent, Hanau am Main; Wolfram Schnabel, Idstein; Klaus-Dietrich Fritzsche, Oberhausen; Heribert Koenig, Duisburg; Gero Rath, Mülheim, all of Fed. Rep. of Germany

[73] Assignees: Metallgesellschaft Aktiengesellschaft, Frankfurt; Mannesmann Aktiengesellschaft, Dusseldorf, both of Fed. Rep. of Germany

[21] Appl. No.: 638,912

[22] Filed: Aug. 8, 1984

[30] Foreign Application Priority Data

Aug. 25, 1983 [DE] Fed. Rep. of Germany ..... 3330625
Sep. 22, 1983 [DE] Fed. Rep. of Germany ..... 3334221

[51] Int. Cl.[4] ..... C21C 5/52

[52] U.S. Cl. ..... 75/11; 75/26; 75/34; 75/38

[58] Field of Search ..... 75/11, 38, 60, 26, 34

[56] References Cited

U.S. PATENT DOCUMENTS

| | | | |
|---|---|---|---|
| 3,224,871 | 12/1965 | Collin | 75/38 |
| 4,218,241 | 8/1980 | Hegemann | 75/60 |
| 4,244,732 | 1/1981 | Brauns | 75/38 |

*Primary Examiner*—Peter D. Rosenberg
*Attorney, Agent, or Firm*—Sprung Horn Kramer & Woods

[57] ABSTRACT

Sponge iron is produced by a direct reduction with solid carbonaceous reducing agents. In order to permit a melting of the sponge iron, particularly of that part thereof which is inferior in metallurgical properties, in a process which is as simple and economical as possible, the exhaust gas from the direct reduction process is used to produce electrical energy, which is supplied to the electric reducing furnace, and sponge iron at a rate corresponding to the electrical energy that is produced is charged to the electrical reducing furnace and comprises at least part of the sponge iron which is inferior in metallurgical properties.

8 Claims, 1 Drawing Figure

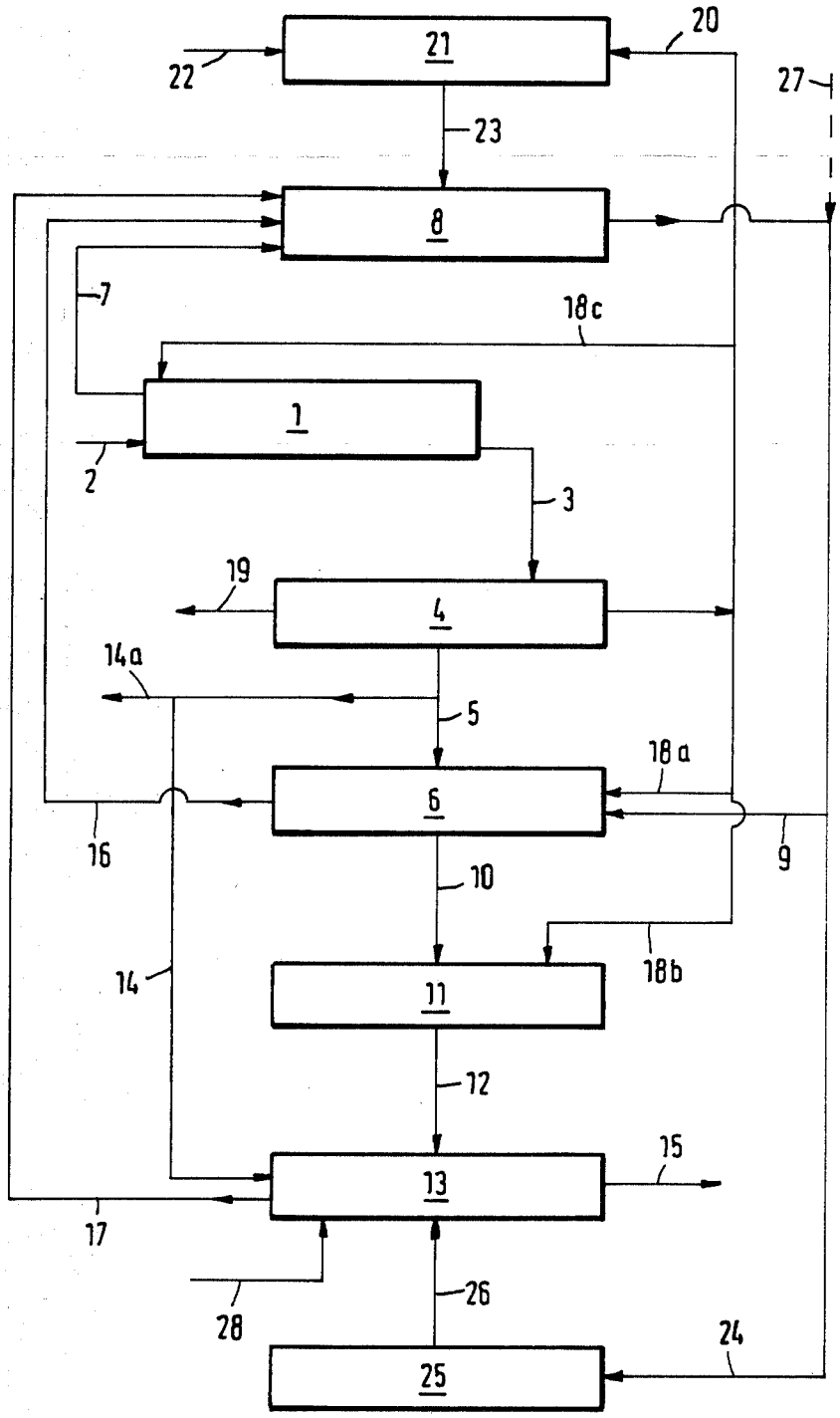
21
20
22
27
23
8
7
18c
1
2
3
19
4
14a
5
18a
6
16
9
10
18b
14
11
12
15
13
17
28
26
24
25

PROCESS OF PRODUCING LIQUID CARBON-CONTAINING IRON

BACKGROUND OF THE INVENTION

1. Field of the Invention

This invention relates to a process of producing liquid carbon-containing iron (hot metal) wherein iron oxide-containing materials are directly reduced with solid carbonaceous reducing agents to form sponge iron, and sponge iron is melted in an electric reducing furnace.

2. Discussion of Prior Art

Difficulties are involved in the melting of sponge iron in electric arc furnaces, particularly when the arc furnace is charged only with sponge iron. The term "arc furnaces" describes directly heated arc furnaces, which are heated by electric arcs struck between the electrodes and the metallic charge or the steel bath (direct arc furnace). For this reason a process of melting sponge iron in electric reducing furnaces has been developed. The term "electric reducing furnaces" describes furnaces in which electrodes are dipped preferably into an open or semi-covered slag bath or into an upright column of burden and in which energy is converted mainly by resistance heating in the slag bath (submerged arc furnace).

The melting of sponge iron in electric reducing furnaces has been described, e.g., in "Stahl und Eisen" 97 (1977) on pages 7 to 17. Those processes are mainly intended for a substitution of the electric arc furnace, i.e., for the making of steel containing up to about 1% carbon. The sponge iron charge contains more than 1% carbon because it has been obtained by a direct reduction with CO-containing gaseous reducing agents. 6 mm has been stated as a lower limit for the particle size of the sponge iron charge, and the metallization is about 90%. It is apparent that the charge consists of sponge iron having a relatively high carbon content and good metallurgical properties. Electric power is supplied from a public power supply system.

The sponge iron produced by a direct reduction with solid carbonaceous reducing agents has a much lower carbon content, which is generally below 0.5%. Part of said sponge iron is inferior in metallurgical properties because it has a lower metallization and/or a smaller particle size. Difficulties are encountered and additional costs may be incurred particularly in the melting of that sponge iron which is inferior in metallurgical properties.

It is an object of the invention to provide a process by which the sponge iron produced by a direct reduction with solid carbonaceous reducing agents, particularly that portion of said sponge iron which is inferior in metallurgical properties, can be melted in a manner which is as simple and economical as possible.

SUMMARY OF INVENTION

That object is accomplished in accordance with the invention in that the exhaust gas from the direct reduction process is used to produce electrical energy, which is supplied to the electric reducing furnace, and sponge iron at a rate corresponding to the electrical energy that is produced is charged to the electric reducing furnace and comprises at least part of the sponge iron which is inferior in metallurgical properties.

The sensible heat and the latent heat of the exhaust gas from the direct reducing process, which latent heat is liberated by afterburning, are used to produce steam.

The steam is used to produce electrical energy, which is supplied to the electric reducing furnace. The rate at which sponge iron is charged is so controlled that the electrical energy which is produced will be sufficient for the production of the desired hot metal. Hot metal is a carbon-unsaturated iron which contains about 1.8 to 2.5% C. For reasons of reaction kinetics, the hot metal cannot be saturated with carbon. To provide that carbon content, carbon is supplied to the furnace at a suitable rate. Short-time fluctuations of the rate at which electrical energy is produced will not be disturbing because the electric reducing furnace can be operated with a variable power input. In case of prolonged fluctuations, a control can be effected by a control of the rate at which sponge iron is charged. Unless the sponge iron produced by the direct reduction is subjected to a separating treatment, a mixture of sponge iron which is inferior in metallurgical properties and of sponge iron which is superior in metallurgical properties will be charged to the electric reducing furnace. If a separation is effected, only the sponge iron which is inferior in metallurgical properties will be charged first and only when that rate is inadequate will the superior sponge iron be charged too. That sponge iron which is not charged into the electric reducing furnace may be sold or may be used for other purposes. The sponge iron may be charged at elevated temperatures to the electric reducing furnace. The hot metal which has been produced may be cast or granulated or may be subjected to further processing in a liquid state. The direct reduction is particularly carried out in a rotary kiln but may also be effected by other methods, e.g., in a circulating fluidized bed supplied with fine-grained ores.

According to a preferred further feature, the sponge iron is subjected to a separating treatment before it is charged to the electric reducing furnace and the electric reducing furnace is charged with that fraction of the sponge iron which is inferior in metallurgical properties and has become available in the separating treatment. The separating treatment may be effected by sieving and magnetic separation and may be carried out at elevated temperatures or in the cold. The following fractions may become available as a result of the separating greatment: coarse sponge iron, fine-grained sponge iron, surplus carbon, ash and desulfurizing agent. In that case all sponge iron which is inferior in metallurgical properties can be charged to the electric reducing furnace and the fraction which is superior in metallurgical properties can be sold or subjected to further processing. The separating treatment may be carried out in such a manner that the fraction having the best metallurgical properties will become available for being sold or used for other purposes. The carbon required in the electric reducing furnace may be supplied exactly in the desired proportion and may comprise the surplus carbon which has been separated, particularly if it is of high quality because it has relatively low ash and sulfur contents. The surplus carbon may alternatively be recycled to the direct reducing process or may be used for other purposes.

In accordance with a further preferred feature the hot metal produced in the electric reducing furnace is carburized to produce crude iron. The carburization is suitably effected in a ladle by an addition of carbon. For that purpose the hot metal is sufficiently overheated in the electric reducing furnace to enter the carburizing stage at a temperature which is about 150° C. above the liquidus line. The carbon used may consist of surplus carbon which has been separated after the direct reduction. The carburization may increase the carbon content to about 4%.

According to a particularly preferred feature the hot metal or the crude iron is blown to produce steel in a process in which sponge iron is added as a coolant. The blowing to produce steel is carried out by means of oxygen-containing gases, preferably technically pure oxygen, in a converter. The coolant consists preferably of the sponge iron which is superior in metallurgical properties and has become available in the separating treatment. In that case the sponge iron which is inferior in metallurgical properties is melted with optimum utilization of the heat content of the exhaust gas from the direct reducing process and the sponge iron which is superior in metallurgical properties is used to produce steel. The system is highly flexible. Surplus sponge iron which is superior in metallurgical properties can still be used for other purposes. Part of the electrical energy which has been produced may be used to produce oxygen.

In a further preferred feature, the temperature and/or the combustible content of the exhaust gas from the direct reducing process is increased in order to increase the electrical energy which is produced. The temperature and/or the combustible content is increased above the values required for the direct reduction. This may be accomplished by the use of coal having a high content of volatile constituents which are not used in the direct reducing process or by the supply of coal at a higher rate. As a result, a larger portion of the sponge iron can be melted.

According to a further preferred feature, the exhaust gas from the electric reducing furnace is used to produce electrical energy. In that case a larger portion of the sponge iron can be melted.

According to a preferred feature, the exhaust gas from the converter is used to produce electrical energy. In that case a larger portion of the sponge iron can be melted.

According to a preferred feature, additional electrical energy is produced by a combustion of carbon. That carbon may consist of the surplus carbon which has been separated after the direct reducing process. Particularly carbon having poor metallurgical properties, e.g., high ash and sulfur contents, can be usefully employed without difficulty in that manner. Additionally, inexpensive coals, e.g., lignite, as well as gas or oil may be used. The combustion is preferably effected in a circulating fluidized bed. Such processes have been described in German Pat. No. 2,539,546; U.S. Pat. No. 4,165,717; Laid-open German Application No. 2,624,302; U.S. Pat. No. 4,111,158. The production of electrical energy by means of the hot combustion gases may be effected jointly with the production of energy by means of the exhaust gas from the direct reducing process or may be separate therefrom.

According to a further feature, the additional electrical energy is produced at such a controlled rate that the entire sponge iron is melted to hot metal in the electric reducing furnace. As a result, the entire sponge iron can be processed for the production of a valuable precursor material which has a much smaller volume and can be transported and stored without difficulty.

According to a further feature, the additional electrical energy is produced at such a controlled rate that the entire sponge iron is processed to produce steel. For instance, if the electrical energy produced with the aid of the exhaust gas is sufficient for melting 50% of the sponge iron to form hot metal and additional 20% of the sponge iron are required as a coolant for the blowing of that hot metal to produce steel, there will be a remainder of 30% of the sponge iron. In that case, additional electrical energy will be produced at such a rate that such a part of the remaining 30% sponge iron is melted to form hot metal that when that hot metal is blown to produce steel the other part of the remainder will be required as a collant. In that manner, the entire sponge iron can be melted and processed in the production of a high-grade end product.

According to a further feature any electrical energy which is lacking is taken from a public power supply system. Because the production of hot metal can be controlled in a wide range, the lacking electrical energy can be taken from the public power supply system at a substantially constant rate so that it is not necessary to provide a public power supply system which has a high power capacity and could supply high peak powers for short times.

According to a preferred feature, the process of blowing to produce steel is performed with the addition of fuels. The fuels can be introduced into the blowing aggregate in solid, gaseous or fluid form, for instance fine-grained coal can be blown into the bath. In the blowing process the necessary heat is developed mainly by combustion of carbon in the bath. If the amount of carbon which is introduced by the feed materials is not sufficient in order to develop the necessary heat, then it is possible by this method to supply the deficiency in the amount of necessary heat directly by primary energy in an economical manner. The system is made very flexible by the addition of the fuels. If, for instance, the amount of oxygen produced with the exhaust gases is sufficient for the production of the desired amount of steel, but the amount of electrical energy produced with the exhaust gases does not reach to produce the respective necessary amount of hot metal or crude iron, then a respective greater amount of sponge iron and/or scrap can can be charged due to the addition of the fuels into the blowing aggregate. In the same manner, it is possible to balance variations in the amount of produced electrical energy. The possibility for adjusting exists as well for the blowing of a part of the sponge iron to steel as for the blowing of all sponge iron to steel.

The oxygen can also be produced by means of a steam turbine which is directly connected to a compressor. The produced oxygen can be sorted and used as a buffer in case of process variation. It is also possible to use gas turbines for the production of electrical energy.

BRIEF DESCRIPTION OF DRAWING

The invention will be explained more in detail with reference to the accompanying drawing.

DESCRIPTION OF SPECIFIC EMBODIMENT

The rotary kiln 1 is supplied with a charge 2 consisting of iron ore, coal, and fluxes. The reduced material 3 is supplied to a separating stage 4, which comprises sieving means and means for a magnetic separation. For the sake of simplicity, only one outlet is shown for each product. The sponge iron 5 which is inferior in metallurgical properties is charged to the electric reducing furnace 6. The exhaust gas 7 from the rotary kiln 1 is supplied to the plant 8 for producing electrical energy. Plant 8 comprises an after-burner, steam generator and an electric power producer. Electrical energy 9 is supplied to the electric reducing furnace 6. The hot metal product 10 is carburized in the carburizer 11, which consists of a ladle. The carburized iron 12 is charged into the converter 13 and is blown to produce steel 15. The converter 13 is also supplied with a coolant consisting of sponge iron 14 having good metallurgical properties.

The exhaust gas 16 from the electric reducing furnace 6 and the exhaust gas 17 from the converter 13 are also supplied to the plant 8 for producing electrical energy.

The surplus carbonaceous material 18*a*, 18*b*, 18*c* which has been separated in the separating stage 4 and has good metallurgical properties is supplied in part to the electric reducing furnace 6, in part to the carburizer 11 and in part to the rotary kiln 1.

Ash and desulfurizing agents are removed as tailings 19 from the separating stage 4. The surplus carbonaceous material 20 which has poor metallurgical properties is supplied to the combustion zone 21, which is constituted by circulating fluidized bed and which is supplied with additional carbonaceous material 22. The hot combustion gases 23 are supplied to the plant 8 for producing electrical energy. Electrical energy 24 is supplied to the oxygen producer 25. The oxygen 26 is supplied to the converter 13. Electrical energy not available from the process can be taken from a public power supply system 27.

Part of the sponge iron 14*a* having good metallurgical properties may be withdrawn for other purposes. Instead of the surplus carbonaceous material 18*a*, 18*b*, 18*c*, other carbon may be used. Unless the hot metal 10 or the carburized iron 12 is blown to produce steel, it can be cast or granulated.

Fuels can be fed through line 28 into converter 13. For instance, fine-grained coal can be blown into the bath.

The advantages afforded by the invention reside in that the sponge iron which becomes available in the direct reduction with solid carbonaceous reducing agents and which has a relatively low carbon content can be melted with an optimum utilization of the heat content of the exhaust gases. Specifically, that portion of the sponge iron which is inferior in metallurgical properties can be processed to produce a precursor product which can be used without restriction. An integrated process can be carried out, which does not require extraneous energy or requires only extraneous energy that can be produced at low cost. The process can be carried out in a highly flexible manner.

By the term "sponge iron which is inferior in metallurgical properties" is meant sponge iron having an iron oxide content corresponding to a degree of metallization below about 90% and/or having a grain size below about 6 mm. In those cases where the sponge iron has been separated into a fraction with superior metallurgical properties and one or more fractions with inferior metallurgical properties, those fractions having an iron oxide content corresponding to a degree of metallization below about 90% and/or having a grain size below about 6 mm are considered "inferior" and the fraction with a metallization above about 90% and/or a grain size above about 6 mm is considered to be the superior fraction, i.e., a fraction having superior metallurgical characteristics. If there is more than one inferior fraction, then that fraction which has the better metallurgical properties, i.e., a higher metallization and/or grain size, can be added to the superior fraction if the amount of the superior fraction shall be increased, for instance for having more coolant material. If no steps are taken to separate the sponge iron into different fractions, following direct reduction, the sponge iron contains both fractions, namely, sponge iron with superior and inferior metallurgical properties. In this case, the charge for the electric reducing furnace consists always of inferior and superior sponge iron.

What is claimed is:

1. In a process of producing liquid carbon-containing iron wherein iron oxide-containing materials are directly reduced with solid carbonaceous reducing agents to form sponge iron, and sponge iron is thereafter melted in an electric reducing furnace, the improvement comprising:

(a) separating the material discharged from the direct reduction by magnetic separation into sponge iron and non-magnetic material containing surplus carbon, (b) producing electrical energy by afterburning the exhaust gas of the direct reduction, (c) producing additional electrical energy from hot combustion gases produced in a combustion aggregate, (d) charging at least part of carbon-containing non-magnetic material obtained according to step (a) into the combustion aggregate according to step (c), (e) wherein the sponge iron obtained according to step (a) is charged into and melted in the electric reducing furnace into liquid carbon-containing iron and, (f) wherein the sum of the rate of produced electrical energy according to steps (b) and (c) equals at least the rate of electrical energy necessary for melting the sponge iron to liquid carbon-containing iron according to step (e) and wherein the necessary rate of electrical energy is applied to the electrical reducing furnace.

2. A process according to claim 1, wherein the hot metal produced in the electrical reducing furnace is carburized to produce crude iron.

3. A process according to claim 1, wherein hot metal obtained from said electric reducing furnace is blown to produce steel in a converter.

4. A process according to claim 1, wherein the temperature and/or the combustible content of the exhaust gas from the direct reducing process is increased in order to increase the electrical energy which is produced.

5. A process according to claim 1, wherein the exhaust gas from the electric reducing furnace is used to produce electrical energy.

6. A process according to claim 3, wherein exhaust gas from the converter is used to produce electrical energy.

7. A process according to claim 1, wherein needed electrical energy beyond that produced by the process is taken from a public power supply system.

8. A process according to claim 3, wherein the process of blowing to produce steel is performed with the addition of at least one fuel.

* * * * *